US008556783B1

(12) United States Patent
Ihli et al.

(10) Patent No.: US 8,556,783 B1
(45) Date of Patent: Oct. 15, 2013

(54) EXERCISE RESISTANCE METHODS AND APPARATUS

(76) Inventors: Stephen P. Ihli, Santa Monica, CA (US); Mark A. Krull, New Braunfels, TX (US)

( * ) Notice: Subject to any disclaimer, the term of this patent is extended or adjusted under 35 U.S.C. 154(b) by 395 days.

(21) Appl. No.: 12/927,253

(22) Filed: Nov. 10, 2010

Related U.S. Application Data

(60) Provisional application No. 61/281,015, filed on Nov. 12, 2009.

(51) Int. Cl.
*A63B 21/015* (2006.01)

(52) U.S. Cl.
USPC ..... 482/115; 482/44; 482/124

(58) Field of Classification Search
USPC ..... 482/92, 114–119, 121–129
See application file for complete search history.

(56) References Cited

U.S. PATENT DOCUMENTS 766,743 A 8/1904 Terry
913,799 A 3/1909 Burguet
1,390,095 A * 9/1921 Dettinger et al. ..... 607/78
1,573,362 A * 2/1926 Stovall ..... 482/148
1,954,762 A * 4/1934 Wolff ..... 482/127
2,951,702 A * 9/1960 Goodwin ..... 482/127
2,959,414 A * 11/1960 Saltz ..... 482/127
3,610,617 A * 10/1971 Hepburn ..... 482/116
3,841,627 A * 10/1974 Vetter ..... 482/110
3,885,789 A * 5/1975 Deluty et al. ..... 482/120
4,174,832 A * 11/1979 Thompson ..... 482/120
4,328,965 A * 5/1982 Hatfield ..... 482/122
4,625,962 A * 12/1986 Street ..... 482/116
4,779,866 A * 10/1988 Marshall et al. ..... 482/116
4,948,119 A * 8/1990 Robertson, Jr. ..... 482/56
5,195,937 A * 3/1993 Engel et al. ..... 482/119
5,226,867 A * 7/1993 Beal ..... 482/127
5,292,293 A * 3/1994 Schumacher ..... 482/4
5,302,161 A * 4/1994 Loubert et al. ..... 482/8
5,324,243 A * 6/1994 Wilkinson ..... 482/92
5,358,461 A * 10/1994 Bailey, Jr. ..... 482/2
5,397,285 A * 3/1995 Haan et al. ..... 482/61
5,437,591 A * 8/1995 Chen ..... 482/127
5,486,149 A * 1/1996 Smith et al. ..... 482/120
5,509,873 A * 4/1996 Corn ..... 482/74
5,618,249 A * 4/1997 Marshall ..... 482/127
5,709,637 A * 1/1998 Gow et al. ..... 482/129
5,733,231 A * 3/1998 Corn et al. ..... 482/120
5,755,646 A * 5/1998 Chu ..... 482/118
5,792,034 A * 8/1998 Kozlovsky ..... 482/124
5,876,310 A * 3/1999 Mackey et al. ..... 482/74
6,099,447 A * 8/2000 Ramsaroop ..... 482/127
6,149,559 A * 11/2000 Mackey ..... 482/124
6,283,899 B1 * 9/2001 Charnitski ..... 482/110
6,315,701 B1 * 11/2001 Shifferaw ..... 482/114
6,544,152 B2 * 4/2003 Rosati ..... 482/126
6,726,607 B1 * 4/2004 Ihli ..... 482/127
6,770,014 B2 * 8/2004 Amore ..... 482/92
7,087,001 B1 * 8/2006 Ihli ..... 482/115

(Continued)

*Primary Examiner* — Stephen Crow

(57) ABSTRACT

An exercise apparatus includes a cable that is extracted from a housing when the extraction force is sufficient to rotate a drum that is rotatably mounted within the housing. A brake material is sandwiched between the drum and a tension band to provide adjustable resistance to rotation of the drum. A knob is rotated to adjust tension in the tension band without affecting tension in the brake material. Indicia on the knob cooperate with indicia on a secondary display member to show changes in the resistance level as the knob rotates through more than one complete revolution relative to the housing.

20 Claims, 9 Drawing Sheets

(56) References Cited

U.S. PATENT DOCUMENTS

| | | | | |
|---|---|---|---|---|
| 7,250,021 | B2 * | 7/2007 | Leight | 482/116 |
| 7,322,909 | B1 * | 1/2008 | Loccarini et al. | 482/129 |
| 2003/0153441 | A1 * | 8/2003 | Berns et al. | 482/128 |
| 2003/0211920 | A1 * | 11/2003 | Mandel | 482/116 |
| 2006/0040805 | A1 * | 2/2006 | Wilkinson | 482/124 |
| 2010/0137105 | A1 * | 6/2010 | McLaughlin | 482/8 |

* cited by examiner

EXERCISE RESISTANCE METHODS AND APPARATUS

CROSS-REFERENCE TO RELATED APPLICATION

Disclosed herein is subject matter that is entitled to the filing date of U.S. Provisional Application No. 61/281,015, filed Nov. 12, 2009.

FIELD OF THE INVENTION

The present invention relates to exercise methods and apparatus, and more specifically, to the provision of selectively adjustable resistance to exercise motion.

BACKGROUND OF THE INVENTION

A variety of exercise devices have been developed to resist exercise motion. For example, U.S. Pat. No. 6,726,607 to Ihli and U.S. Pat. No. 7,087,001 to Ihli disclose exercise resistance devices that are compact and selectively adjustable. An object of the present invention is to provide improved exercise resistance devices that are compact and selectively adjustable.

SUMMARY OF THE INVENTION

In one sense, the present invention may be described as an exercise apparatus having a drum that is rotatably mounted on a frame for rotation about an axis, and that defines a circumferential perimeter. A tension band is disposed about at least a portion of the perimeter of the drum, and a braking strip disposed between the tension band and the drum. A tension adjustment mechanism is interconnected between the tension band and the frame, and operable to adjust tension in the tension band without affecting tension in the braking strip. A force receiving member is operatively connected to the drum in such a manner that movement of the force receiving member is linked to rotation of the drum.

In another sense, the present invention may be described in terms of an exercise apparatus having a drum that is rotatably mounted on a frame for rotation about an axis, and that defines a circumferential perimeter of steel. A tension band is disposed about at least a portion of the perimeter of the drum. A Kevlar braking strip is disposed between the tension band and the drum, and the braking strip is connected to the frame to discourage rotation of the braking strip together with the drum. An adjustment member is movably mounted on the frame for selective movement relative to the frame. The adjustment member is connected to an end of the tension band in such a manner that movement of the adjustment member adjusts tension in the tension band without affecting tension in the braking strip. A force receiving member is operatively connected to the drum in such a manner that movement of the force receiving member is linked to rotation of the drum.

In yet another sense, the present invention may be described as an exercise apparatus having a drum that is rotatably mounted on a frame, and that defines a circumferential perimeter. A tension band is disposed about at least a portion of the perimeter of the drum, and a braking strip disposed between the tension band and the drum. A tension adjustment mechanism is interconnected between the tension band and the frame, and operable to adjust tension in the tension band without affecting tension in the braking strip. A knob is rotatably mounted on the frame and linked to the tension adjustment mechanism, and indicia on the knob indicate resistance to rotation of the drum in increments associated with orientation of the knob. A force receiving member is operatively connected to the drum in such a manner that movement of the force receiving member is linked to rotation of the drum.

Various features and advantages of the present invention will become apparent from the more detailed description that follows.

BRIEF DESCRIPTION OF THE DRAWING

With reference to the Figures of the Drawing, wherein like numerals represent like parts and assemblies throughout the several views.

DETAILED DESCRIPTION OF THE PREFERRED EMBODIMENT

In some respects, the present invention may be described in terms of improvements to the exercise apparatus disclosed in U.S. Pat. No. 6,726,607 to Ihli and U.S. Pat. No. 7,087,001 to Ihli, both of which are incorporated herein by reference to contribute to understanding of the construction, operation, and/or use of the present invention. As a result, the following description focuses primarily on distinctions between these prior art devices and the present invention, and takes into account the fact that shared attributes are already disclosed in the above-referenced patents. Nonetheless, persons skilled in the art will recognize that certain aspects of the present invention may also be practiced in connection with devices other those disclosed in the above-referenced patents.

Figure 1:
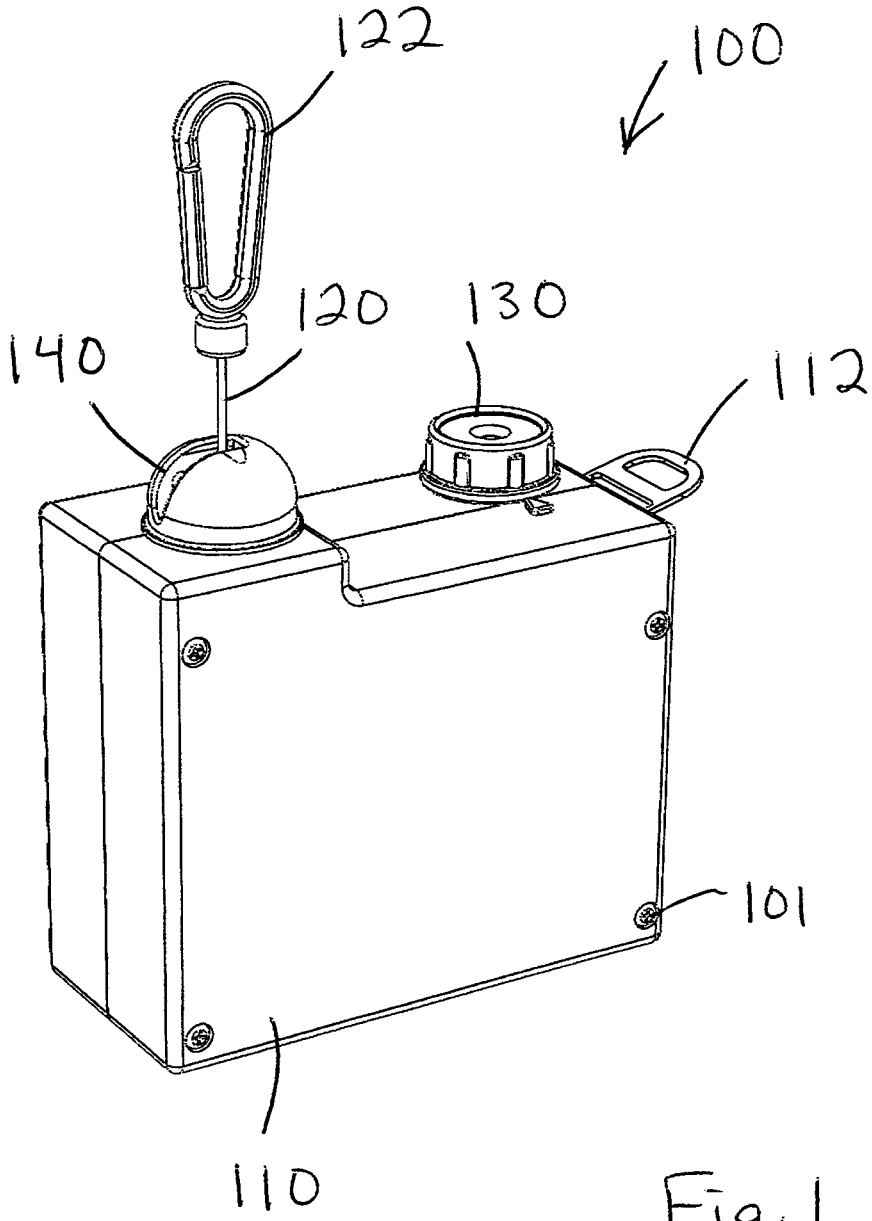
FIG. 1 is a perspective view of an exercise apparatus constructed according to the principles of the present invention.

An exercise apparatus constructed according to the principles of the present invention is designated as 100 in FIG. 1. The apparatus 100 includes a frame or housing 110, and a cable 120 that is extracted from the housing 110 when the extraction force exceeds an adjustable level of resistance. As disclosed in the above-referenced patents, the cable 120 is wound about a sheave, which in turn, is mounted on a rotatable shaft via a one-way clutch bearing. Also, a rewind spring is interconnected between the sheave and the housing 110 to bias the sheave in a first rotational direction. As a result, the sheave rotates together with the shaft in an opposite, second rotational direction in response to extraction of the cable 120, and when the cable 120 is released, the rewind spring rotates the sheave relative to the shaft to retract the cable 120 within the housing 110. A resistance drum is keyed to the shaft to provide resistance to rotation of the shaft in either direction.

A knob 130 is rotatably mounted on top of the housing 110, and rotates relative to the housing to adjust the level of resistance experienced by the drum. A re-directional bearing assembly 140 is movably mounted on top of the housing 110, and the cable 120 is routed through the re-directional bearing assembly 140 to accommodate extraction of the cable 120 in any direction having an upward component relative to the top of the housing 110. A carabineer clip 122 is connected to an outer distal end of the cable 120 to releasably connect the cable 120 to any of various force receiving members, including a second apparatus 100 (via ring member 112) or a conventional force receiving member, such as the handle shown in FIG. 11 of U.S. Pat. No. 7,087,001, for example.

Figure 2:
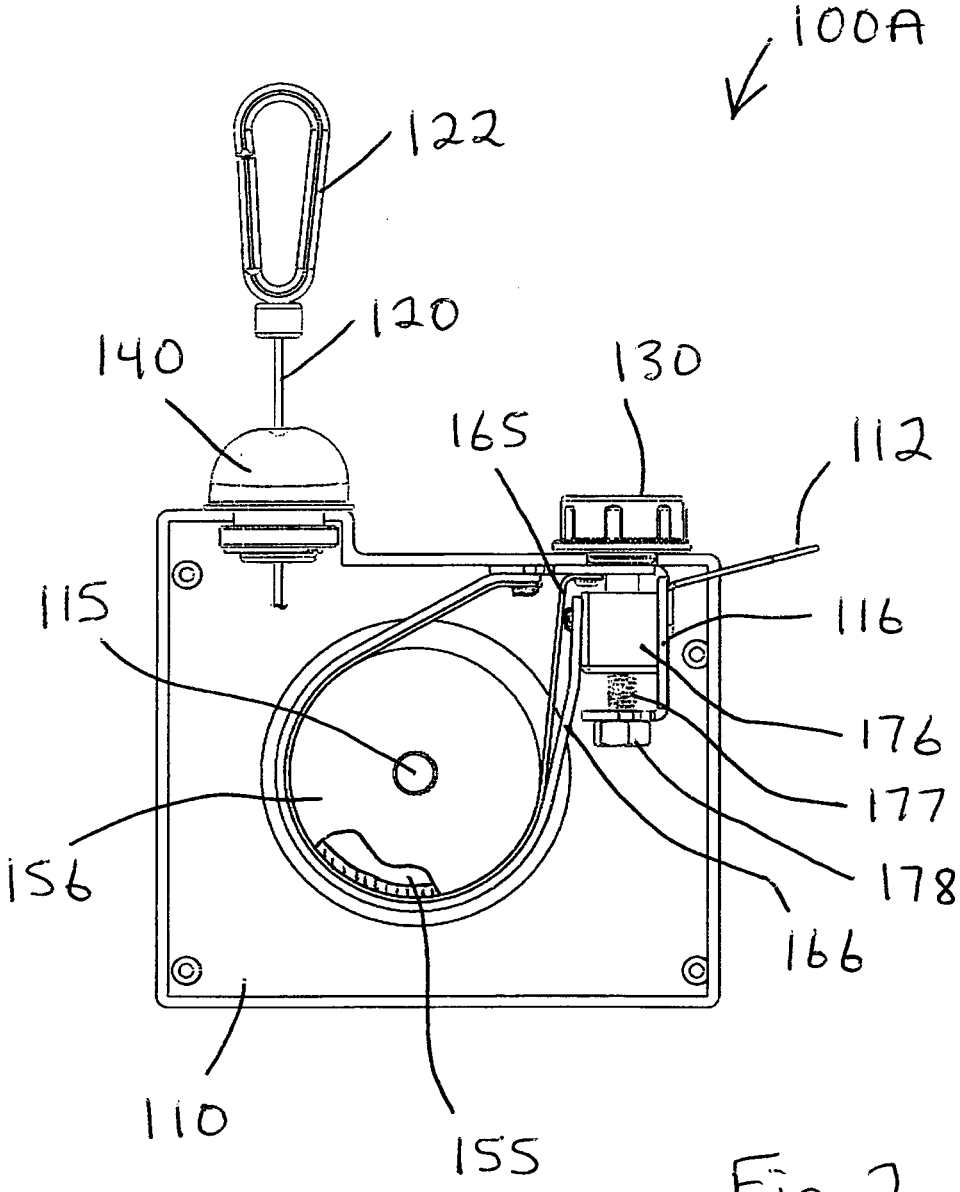
FIG. 2 is a side view of the exercise apparatus of FIG. 1, with certain components removed to better illustrate other components.

As suggested by the common reference numerals, FIG. 2 shows a first variation 100A of the exercise apparatus 100 shown in FIG. 1. On this embodiment 100A, a cylindrical steel cap 156 is rigidly mounted on a plastic hub 155 to define a brake drum having a circumferential perimeter of steel. The hub 155 is keyed to a shaft 115, which in turn, is rotatably mounted on the housing 110 (as described above). A stainless steel tension band 166 is secured in a loop about at least a portion of the perimeter of the cap 156, and a Kevlar brake strip 165 is sandwiched between the cap 156 and the tension band 166. These specific components cooperate to define a preferred resistance means or system, but persons skilled in the art may recognize other combinations of suitable materials that may mixed and matched to provide alternative systems.

In addition to complementary first and second housing halves or shells, the housing 110 includes a bracket or frame member 116 that is preferably a stamped metal part. The frame member 116 is preferably secured in place between the shells by means of internal structure on the housing shells, as well as fasteners 101 that secure the shells to one another. A first rivet or other suitable fastener secures a first end of the brake strip 165 to a first portion of the frame member 116. A second rivet or other suitable fastener secures an opposite, second end of the brake strip 165 to a discrete, second portion of the frame member 116. The second rivet also preferably secures an end of the tension band 166 to the second portion of the frame member 116.

An opposite end of the tension band 166 is secured to a slide block 176 by means of a separate fastener, which is preferably a screw. The slide block 176 is threaded onto a bolt 177, and the slide block 176 bears against the frame member 116 in a manner that prevents rotation while allowing linear travel of the former relative to the latter. The bolt 177 is rotatably mounted within upper and lower openings in the frame member 116. An upper end of the bolt 177 is keyed to the knob 130, and a lower end of the bolt 177 is rigidly fastened to a nut 178. A thrust bearing is preferably disposed between the knob 130 and the frame member 116 to accommodate relative rotation therebetween. The foregoing elements cooperate to rotatably mount the bolt 177 in a specific position relative to the frame. A lower end of the frame member 116 is configured and arranged to limit downward travel of the slide block 176 along the bolt 177. On an alternative embodiment, a pin or other suitable stop is preferably secured to a lower section of the bolt 177 to function as the stopping means.

When the knob 130 is rotated in a first direction, tension in the tension band 166 increases, and when the knob 130 is rotated in an opposite, second direction, tension in the tension band 166 decreases. In either case, tension in the brake material 165 remains relatively unaffected, while compression of the brake material 165 against the cap 156 increases or decreases in direct relation to the change in tension in the tension band 166. On a working embodiment of the device 100A, the resulting resistance experienced by a user is smooth and predictable through a range of resistance from 2 to 40 pounds in response to less than two full rotations of the knob 130.

Figure 3:
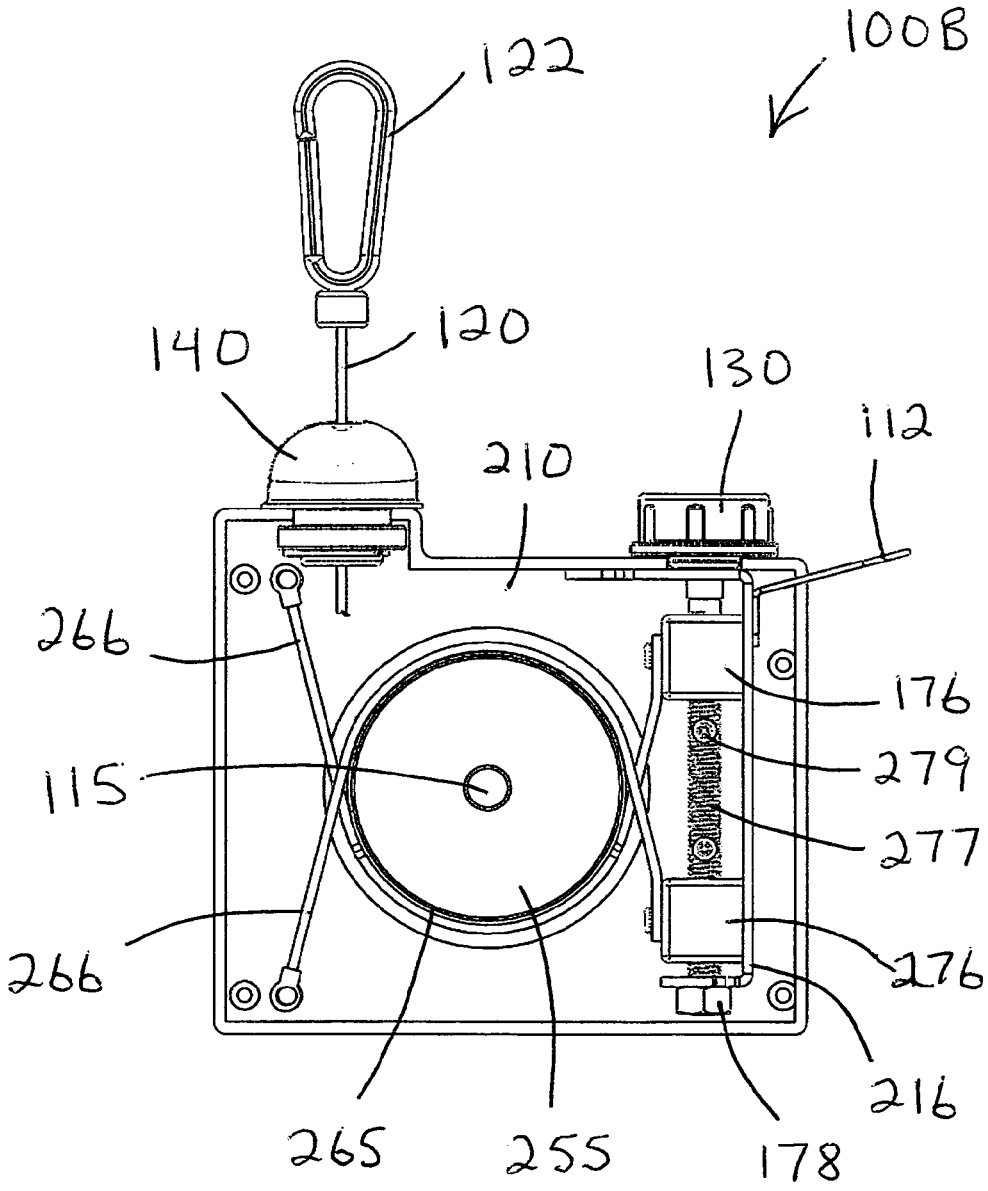
FIG. 3 is a side view of another exercise apparatus constructed according to the principles of the present invention, with certain components removed to better illustrate other components.

As suggested by the common reference numerals, FIG. 3 shows a second variation 100B of the exercise apparatus 100 shown in FIG. 1. On this embodiment 100B, a vacuum belt 265 is rigidly secured about the perimeter of a plastic hub 255 to define a brake drum. The hub 255 is keyed to a shaft 115, which in turn, is rotatably mounted on the housing 210 (as described above). A first stainless steel tension band 266 is secured in a loop about at least a portion of the belt 265, and a second stainless steel tension band 266 is secured in a loop about at least a portion of the belt 265. The two bands 266 are configured (e.g. notched) to cross over one another without interfering with one another. These specific components cooperate to define a preferred resistance means or system, but persons skilled in the art may recognize other combinations of suitable materials that may mixed and matched to provide alternative systems.

A first internal pin or other suitable fastener secures a first end of one tension band 266 to the housing 210, and a second internal pin or other suitable fastener secures a second end of the other tension band 266 to the housing 210. In addition to complementary first and second housing halves or shells, the housing 210 includes a bracket or frame member 216 that is preferably a stamped metal part. The frame member 216 is preferably secured in place between the shells by means of internal structure on the housing shells, as well as fasteners 101 that secure the shells to one another. An opposite end each tension band 266 is secured to a respective slide block 176 or 276 by means of a respective fastener, which is preferably a screw.

The only difference between the slide block 276 and the slide block 176 is that the thread direction is reversed. Each slide block 176 and 276 is threaded onto a bolt 277, and each slide block 176 and 276 bears against the frame member 216 in a manner that prevents rotation while allowing linear travel of the former relative to the latter. The bolt 277 is rotatably mounted within upper and lower openings in the frame member 216. An upper end of the bolt 277 is keyed to the knob 230, and a lower end of the bolt 277 is rigidly fastened to a nut 178. A thrust bearing is preferably disposed between the knob 130 and the frame member 216 to accommodate relative rotation therebetween. The foregoing elements cooperate to rotatably mount the bolt 277 in a specific position relative to the frame. Pins 279 or other suitable stops are preferably secured to respective sections of the bolt 277 to limit travel of respective slide blocks 176 and 276 along the bolt 277.

When the knob 130 is rotated in a first direction, tension in the tension bands 266 increases, and when the knob 130 is rotated in an opposite, second direction, tension in the tension bands 266 decreases. In either case, compression of the brake material 265 increases or decreases in direct relation to the change in tension in the tension bands 266. Persons skilled in the art will recognize that this arrangement squeezes the hub 255 from opposite directions, thereby doubling the effect of rotating the knob 130 and reducing side-loading on the shaft 115.

FIGS. 4-11 show a resistance display arrangement suitable for use with various resistance devices, including the embodiments disclosed herein. The arrangement includes a frame or housing 310 and a knob 130A that is rotated relative to the housing 310 to adjust resistance. Both the housing 310 and the knob 130A are analogous to their counterparts on the embodiments described above.

Figure 4:
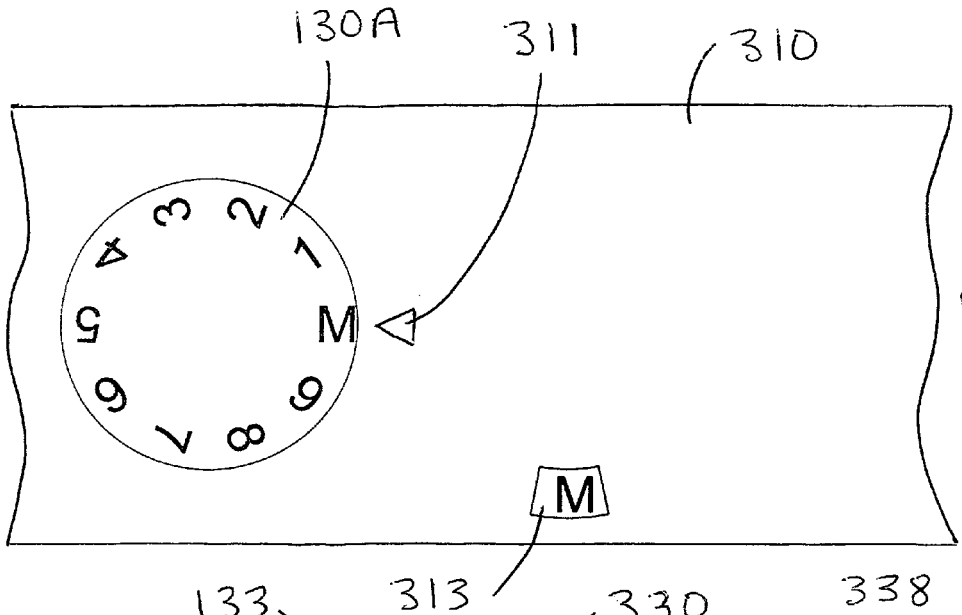
FIG. 4 is a top view of a resistance display arrangement suitable for use on the exercise apparatus of FIGS. 1-3, and displaying a medium level of resistance.

FIG. 4 is a top view of the housing 310, showing indicia on the knob 130A, a pointer 311 on the housing 310 to point at the most proximate of the indicia, and a window 313 in the housing to reveal aligned indicia on a rotating member 330 (shown in FIGS. 5-11). The "M" on the knob 130A cooperates with the "M" in the window to indicate that the knob 130A is set at the medium level of resistance within the total range of resistance.

Figure 5:
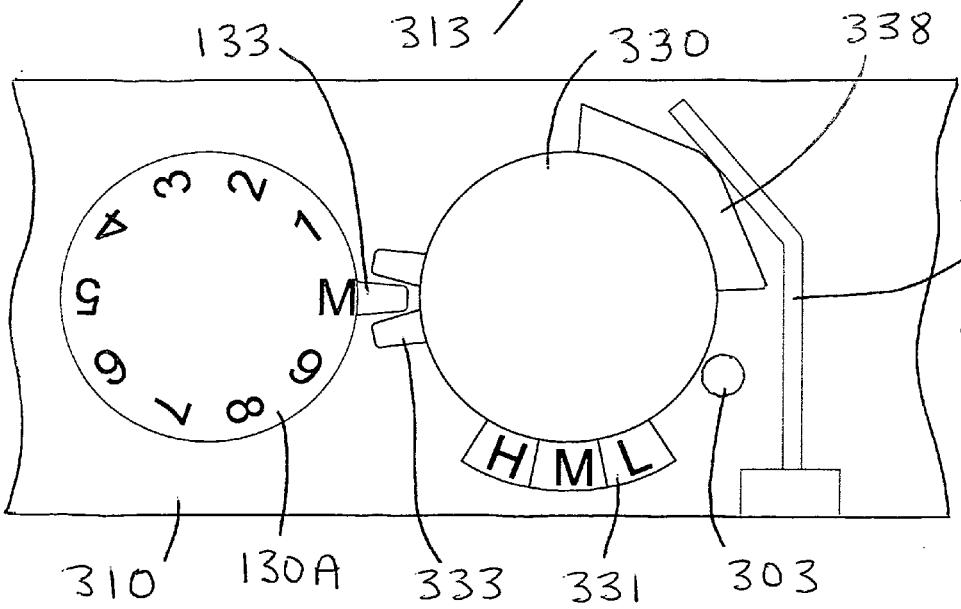
FIG. 5 is a top view of the display arrangement of FIG. 4, with certain components removed to better illustrate other components.

FIG. 5 shows the same view as FIG. 4, but with the top wall of the housing 310 removed. A tab or tooth 133 projects radially outward from the knob 130, and comparable tabs or teeth 333 project radially outward from the rotating member 330. The teeth 333 are configured and arranged to receive the tooth 133 therebetween. A display member 331 projects outward from a circumferential portion of the rotating member 330 and bears the indicia "H", "M", and "L". A cam member 338 projects outward from a circumferential portion of the rotating member 330 and defines three flat surfaces. For reasons discussed below, a stop 303 is rigidly secured to the housing 310 just beyond a circumferential portion of the rotating member 330.

A leaf spring 308 has an anchor end that is rigidly secured to the housing 310, and an opposite, distal end that is configured and arranged to align with any one of the flats as a function of orientation of the rotating member 330. In FIG. 5, the distal end of the leaf spring 308 abuts the relatively shorter, middle flat and thereby biases the rotating member 330 to remain in the orientation shown in FIG. 5.

Figure 6:
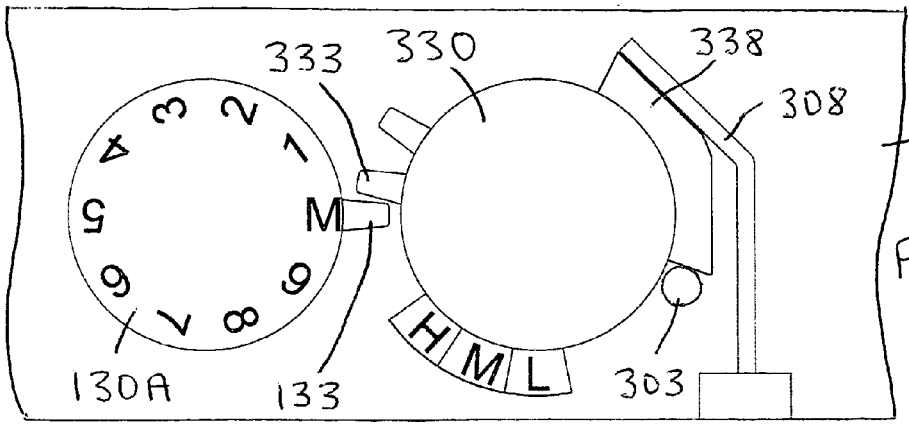
FIG. 6 is a top view of the display arrangement components of FIG. 5, displaying a lower extreme level of resistance within the lower half of the resistance range.

FIG. 6 shows the same view as FIG. 5, but with the knob 130A rotated as far in the counter-clockwise direction as possible. In this regard, the tooth 133 is bearing against the lower side of the lower tooth 333, and the cam member 338 is bearing against the stop 303. The "M" on the knob 130A cooperates with the "L" on the display member 331 to indicate that the knob 130A is set at the minimum level of resistance within the low range of resistance (the lowest available setting). The distal end of the leaf spring 308 abuts one of the longer flats on the cam member 338 and thereby biases the rotating member 330 to remain in the orientation shown in FIG. 6.

Figure 7:
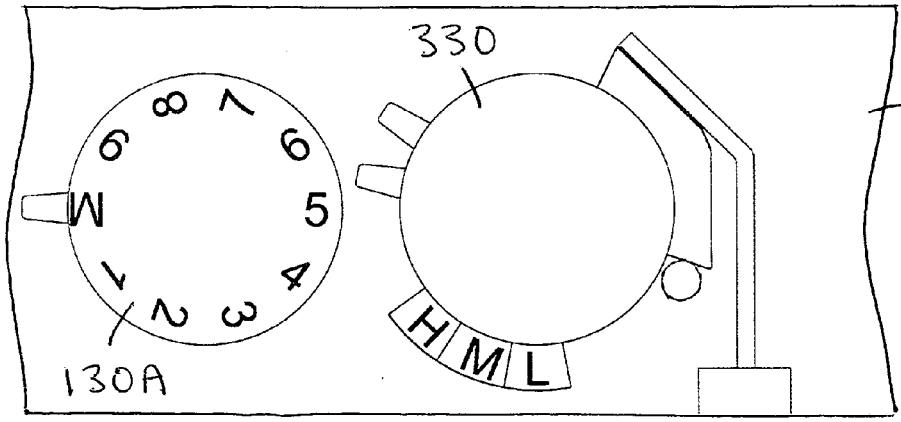
FIG. 7 is a top view of the display arrangement components of FIG. 5, displaying an intermediate level of resistance within the lower half of the resistance range.

FIG. 7 shows the same view as FIG. 6, but with the knob 130A rotated one-half revolution in the clockwise direction. Because the tooth 133 on the knob 130A rotates away from the lower tooth 333 on the rotating member 330, the rotating member 330 remains in the same orientation as in FIG. 6. The "5" on the knob 130A cooperates with the "L" on the display member 331 to indicate that the knob 130A is set at the medium level of resistance within the low range of resistance (about 25% of maximum).

Figure 8:
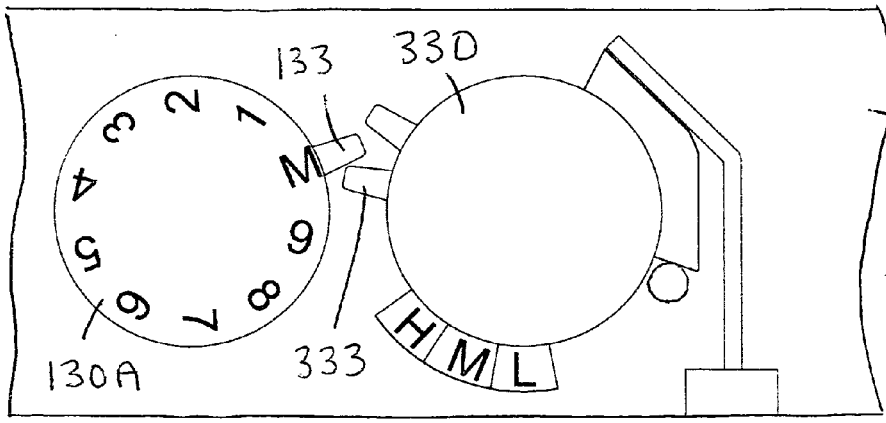
FIG. 8 is a top view of the display arrangement components of FIG. 5, displaying an upper extreme level of resistance within the lower half of the resistance range.

FIG. 8 shows the same view as FIG. 7, but with the knob 130A rotated almost another one-half revolution in the clockwise direction. Because the tooth 133 on the knob 130A rotates away from the lower tooth 333 on the rotating member 330, the rotating member 330 remains in the same orientation as in FIG. 6. The "9" on the knob 130A cooperates with the "L" on the display member 331 to indicate that the knob 130A is set at the maximum level of resistance within the low range of resistance (almost 50% of maximum).

At the setting shown in FIG. 8, the tooth 133 comes into contact with the upper side of the lower tooth 333. As a result, further rotation of the knob 130A in the clockwise direction will cause the rotating member 330 to rotate in the counter-clockwise direction, subject to resistance from the leaf spring 308 bearing against the cam member 338, and then the components will return to the setting shown in FIGS. 4-5.

Figure 9:
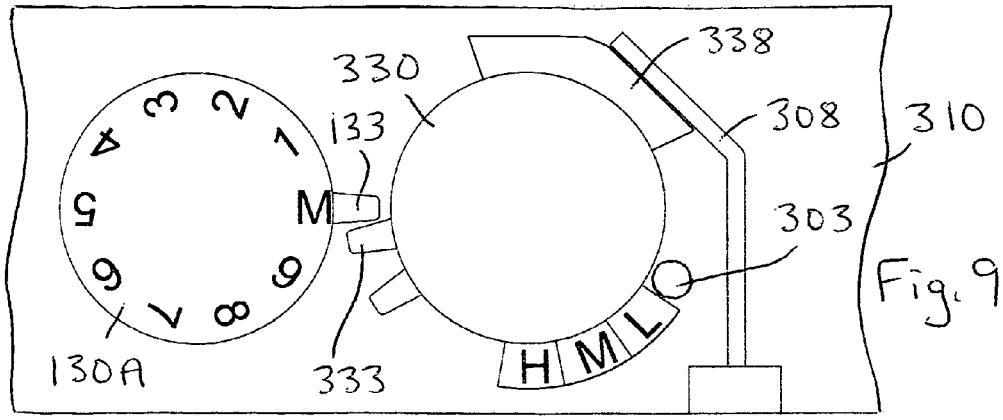
FIG. 9 is a top view of the display arrangement components of FIG. 5, displaying an upper extreme level of resistance within the upper half of the resistance range.

FIG. 9 shows the same view as FIG. 5, but with the knob 130A rotated as far in the clockwise direction as possible. In this regard, the tooth 133 is bearing against the upper side of the upper tooth 333, and the display member 331 is bearing against the stop 303. The "M" on the knob 130A cooperates with the "H" on the display member 331 to indicate that the knob 130A is set at the maximum level of resistance within the high range of resistance (the highest available setting). The distal end of the leaf spring 308 abuts the other long flat on the cam member 338 and thereby biases the rotating member 330 to remain in the orientation shown in FIG. 9.

Figure 10:
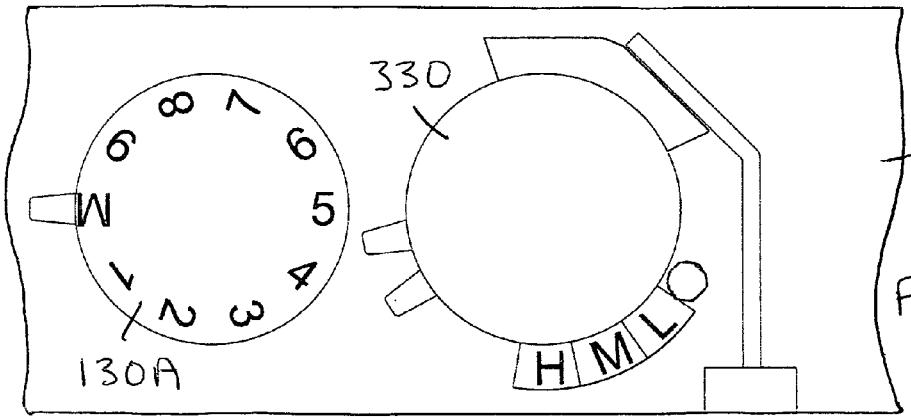
FIG. 10 is a top view of the display arrangement components of FIG. 5, displaying an intermediate level of resistance within the upper half of the resistance range.

FIG. 10 shows the same view as FIG. 9, but with the knob 130A rotated one-half revolution in the counter-clockwise direction. Because the tooth 133 on the knob 130A rotates away from the upper tooth 333 on the rotating member 330, the rotating member 330 remains in the same orientation as in FIG. 9. The "5" on the knob 130A cooperates with the "H" on the display member 331 to indicate that the knob 130A is set at the medium level of resistance within the high range of resistance (about 75% of maximum).

Figure 11:
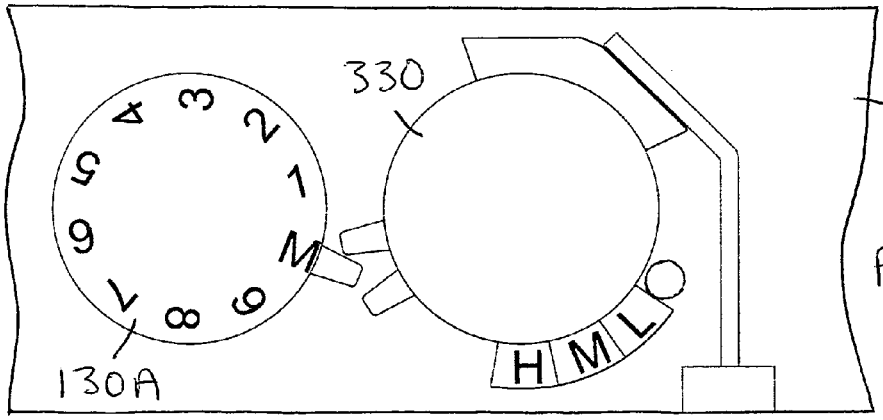
FIG. 11 is a top view of the display arrangement components of FIG. 5, displaying a lower extreme level of resistance within the upper half of the resistance range.

FIG. 11 shows the same view as FIG. 10, but with the knob 130A rotated almost another one-half revolution in the counter-clockwise direction. Because the tooth 133 on the knob 130A rotates away from the upper tooth 333 on the rotating member 330, the rotating member 330 remains in the same orientation as in FIG. 9. The "1" on the knob 130A cooperates with the "H" on the display member 331 to indicate that the knob 130A is set at the minimum level of resistance within the high range of resistance (about 51% of maximum).

At the setting shown in FIG. 11, the tooth 133 comes into contact with the lower side of the upper tooth 333. As a result, further rotation of the knob 130A in the counter-clockwise direction will cause the rotating member 330 to rotate in the clockwise direction, subject to resistance from the leaf spring 308 bearing against the cam member 338, and then the components will return to the setting shown in FIGS. 4-5.

Figure 13:
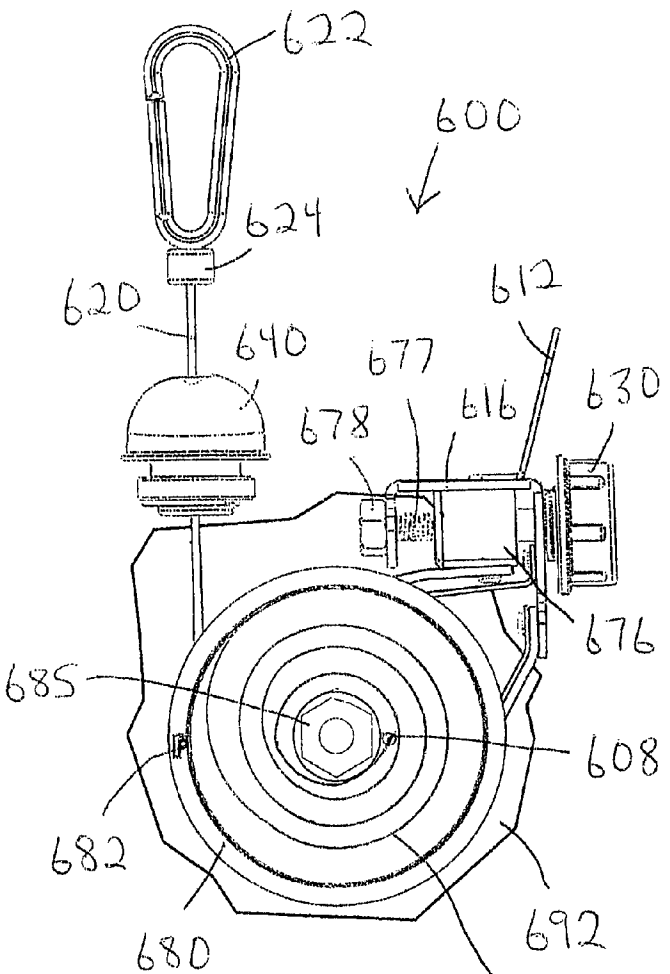
FIG. 13 is another partially sectioned front view of the exercise apparatus of FIG. 12.
Figure 12:
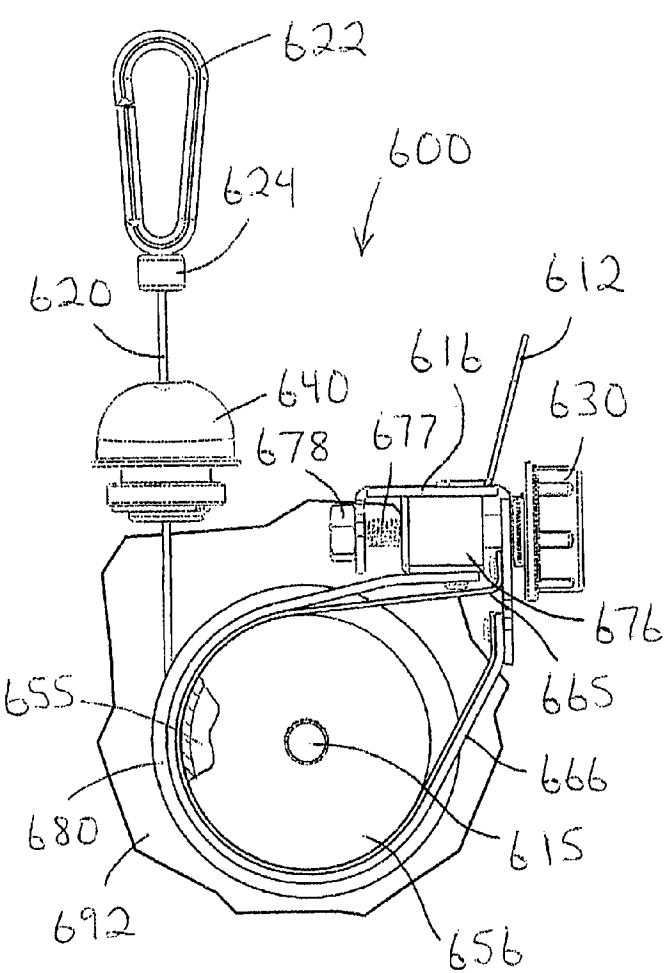
FIG. 12 is a partially sectioned front view of another exercise apparatus constructed according to the principles of the present invention.

FIGS. 12-13 show components of another exercise apparatus 600 constructed according to the principles of the present invention. In many respects, the exercise apparatus 600 is similar to the exercise apparatus 100A described with reference to FIG. 2. The exercise apparatus 600 includes a flexible member or resistance cable 620 that is extracted from housing 692 when the extraction force exceeds an adjustable level of resistance, and that is rewound into the housing 692 when tension in the cable 620 falls below the rewind force exerted by a spring within the housing 692.

As shown in FIG. 12, the cable 620 is wound about a sheave 680, which in turn, is mounted on a rotatable shaft 615 via a conventional one-way clutch bearing 685. A hub 655 is rigidly secured to the shaft 615, and a steel cylindrical cap 656 is rigidly mounted on the hub 655 to define a resistance drum. A stainless steel brake band 666 is secured about a portion of the cap 656 with a Kevlar brake strip sandwiched therebetween. The brake band 666 cooperates with the resistance drum to provide resistance to rotation of the shaft 615 in either direction.

As shown in FIG. 13, a coiled rewind spring 690 is nested within a compartment defined by the sheave 680. An inner end of the spring 690 is anchored to the housing 692 via a peg 608, and an opposite, outer end of the spring 690 is anchored to the sheave 680 via a flange 682. As a result, the spring 690 biases the sheave 680 to rotate in a first rotational direction relative to the shaft 615 and the housing 692. The sheave 680 rotates together with the shaft 615 and relative to the housing 692 in an opposite, second rotational direction in response to extraction of the cable 620. Thereafter, when the cable 620 is released, the rewind spring 690 rotates the sheave 680 relative to the shaft 615 to retract the cable 620 within the housing 692.

A knob 630 is rotatably mounted on an end of the housing 692, and rotates relative to the housing 692 to adjust the level of resistance associated with the resistance drum. The housing 692 includes a bracket or frame member 616 that is preferably a stamped metal part. The frame member 616 is preferably secured in place between opposing "halves" of the housing 692 by means of internal structure on the housing shells, as well as fasteners that secure the halves to one another. A first rivet or other suitable fastener secures a first end of the brake strip 665 to a first portion of the frame member 616. A second rivet or other suitable fastener secures an opposite, second end of the brake strip 665 to a discrete, second portion of the frame member 616. The second rivet also preferably secures an end of the tension band 666 to the second portion of the frame member 616.

An opposite end of the tension band 666 is secured to a slide block 676 by means of a separate fastener, which is preferably a screw. The slide block 676 is threaded onto a bolt 677, and the slide block 676 bears against the frame member 616 in a manner that prevents rotation while allowing linear travel of the former relative to the latter. The bolt 677 is rotatably mounted within upper and lower openings in the frame member 616. An upper end of the bolt 677 is keyed to the knob 630, and a lower end of the bolt 677 is rigidly fastened to a nut 678. A thrust bearing is preferably disposed between the knob 630 and the frame member 616 to accommodate relative rotation therebetween. The foregoing elements cooperate to rotatably mount the bolt 677 in a specific position relative to the frame. A lower end of the frame member 616 is configured and arranged to limit downward travel of the slide block 676 along the bolt 677. On an alternative embodiment, a pin or other suitable stop is preferably secured to a lower section of the bolt 677 to function as the stopping means.

When the knob 630 is rotated in a first direction, tension in the tension band 666 increases, and when the knob 630 is rotated in an opposite, second direction, tension in the tension band 666 decreases. In either case, tension in the brake material 665 remains relatively unaffected, while compression of the brake material 665 against the cap 656 increases or decreases in direct relation to the change in tension in the tension band 666. On a working embodiment of the apparatus 600, the resulting resistance experienced by a user is smooth and predictable through a range of resistance from 2 to 40 pounds in response to less than two full rotations of the knob 630.

A re-directional bearing assembly 640 is movably mounted on top of the housing 692, and the cable 620 is routed through the re-directional bearing assembly 640 to accommodate extraction of the cable 620 in any direction having an upward component relative to the top of the housing 692. Persons skilled in the art will recognize that the re-directional bearing 640 is located at one of six available "corner locations" on the housing 692, and furthermore, that it need not occupy an orthogonal or parallel orientation relative to the longitudinal axis of the adjustment bolt 677.

A bead or stop 624 is rigidly secured to an external portion of the cable 620, and the bead 614 is too large to fit through the opening defined by the re-directional bearing assembly 640, thereby preventing the distal end of the cable 620 from becoming lost inside the housing 692. A carabineer clip 622 is connected to an outer distal end of the cable 620 to releasably connect the cable 620 to any of various force receiving members, including a conventional force receiving member, such as the handle shown in FIG. 11 of U.S. Pat. No. 7,087,001, for example.

Figure 14:
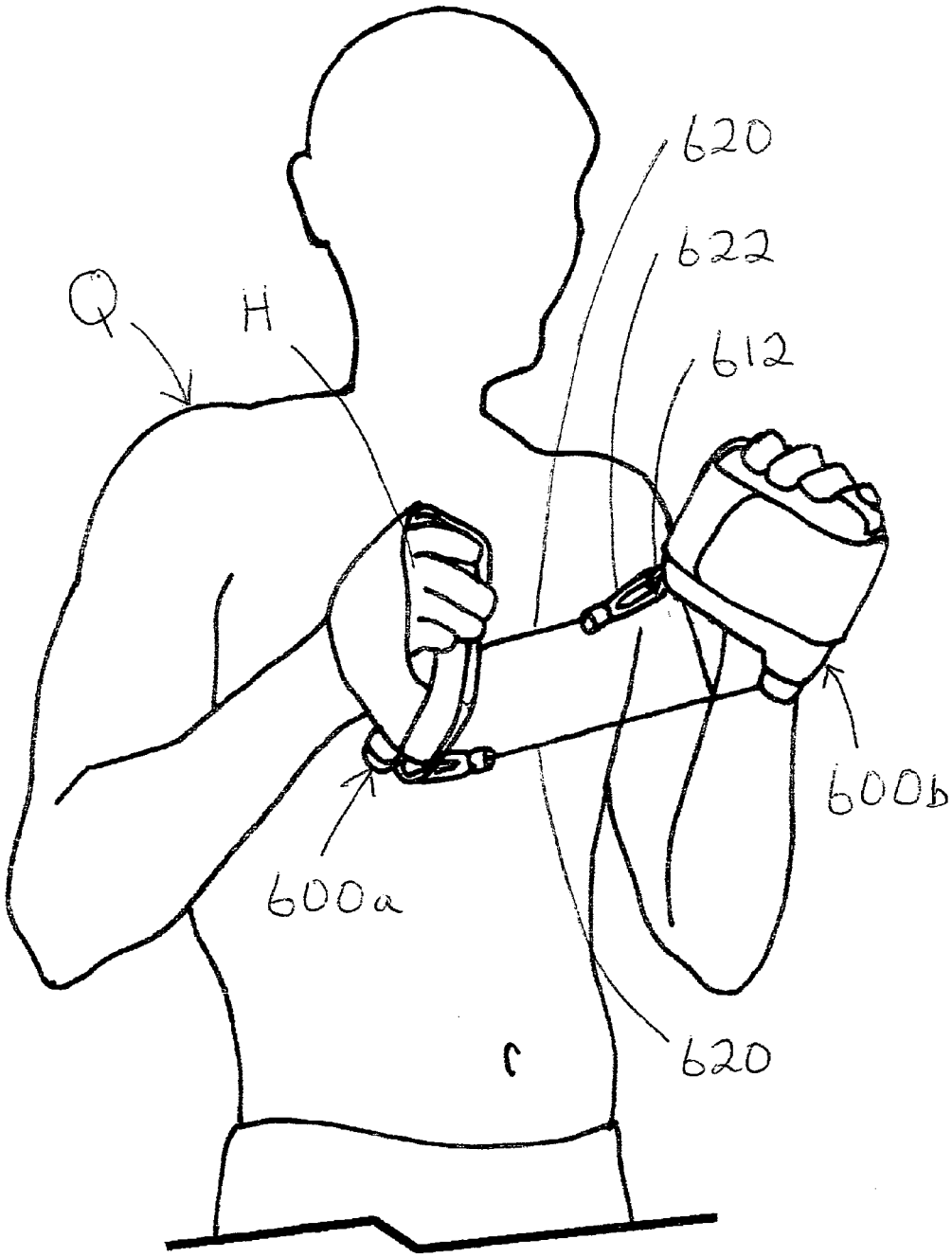
FIG. 14 is a perspective view of a person exercising with two of the exercise apparatus of FIGS. 12-13.

As shown in FIG. 14, two units 600*a* and 600*b* may alternatively be connected to one another at respective attachment members 612. In other words, the carabineer 622 on the left exercise apparatus 600*b* is connected to the attachment member 612 on the right exercise apparatus 600*a*, and the carabineer 622 on the right exercise apparatus 600*a* is connected to the attachment member 612 on the left exercise apparatus 600*b*. When so arranged and held in respective hands H of a person Q, as shown in FIG. 22, the units 600*a* and 600*b* may be used to perform various upper body exercises.

Figure 15:
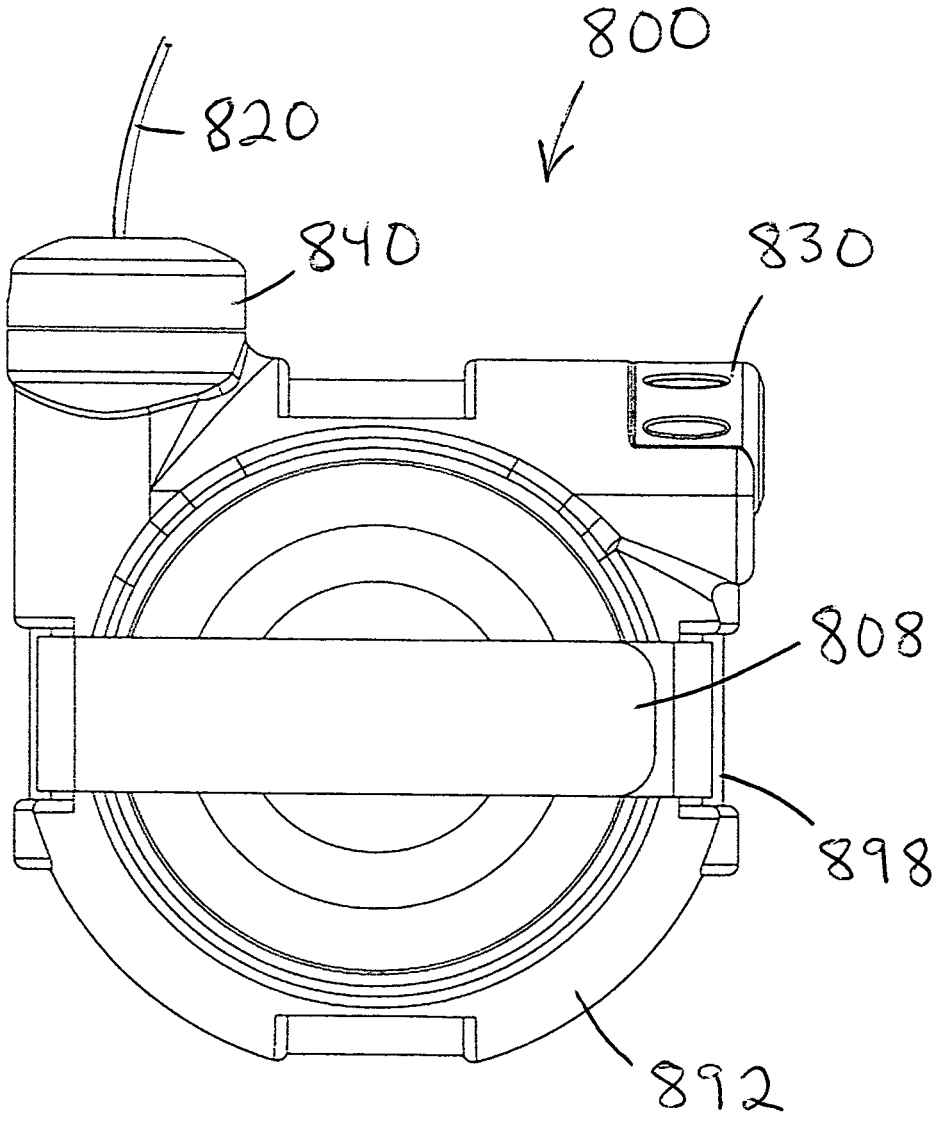
FIG. 15 is a front view of yet another exercise apparatus constructed according to the principles of the present invention.

FIG. 15 shows an exercise apparatus 800 that provides resistance in the same manner as the exercise apparatus 600 described with reference to FIGS. 12-13. Among other things, the exercise apparatus 800 includes a housing 892 that defines notches at 3:00 and 9:00. The notches are interrupted by respective steel pins 898 that cooperate with the main body of the housing 892 to define strap receiving slots. A strap 808 is selectively inserted through each slot and secured to itself via hook and loop type fasteners. The strap 808 accommodates connection to a person's hand along the lines of what is shown in FIG. 14.

As shown in FIG. 15, an adjustment knob 830 is disposed at the upper right corner of the housing 892, and a re-directional bearing 840 is disposed at the upper left corner of the housing 892. A flexible member or cable 820 extends from a distal end, disposed outside the housing 892, through the re-directional bearing 840, to an opposite end portion, wrapped about a sheave. A rewind spring is interconnected between the sheave and the housing 892 to encourage the flexible member 820 to wind onto the sheave, and a band brake arrangement resists removal of the flexible member 820 from the sheave.

Persons skilled in the art will recognize that the subject present invention may be described in terms of methods with reference to the foregoing embodiments. For example, the present invention may be described in terms of a method of providing selectively adjustable resistance to exercise. In one such method, a member is rotatably mounted on a frame to define a rotating cylindrical surface. A tension band is wrapped about at least a portion of the surface, and a brake material is sandwiched between the tension band and the surface. An adjustment mechanism is selectively operated to adjust tension in the tension band with affecting tension in the brake material.

The present invention may also be described in terms of a method for displaying a selected level of resistance to exercise. In one such method, a knob is rotatably mounted on a frame, and rotation of the knob is linked to both adjustment of an exercise resistance mechanism and rotation of a display member. Indicia on the knob cooperate with indicia on the display member to indicate a current resistance setting. For example, indicia on the knob indicate any of several levels within any of several ranges, and indicia on the display member indicate any of several ranges. The indicia associated with the current resistance setting may align with pointers and/or windows on the frame. Alternatively, the current level displayed by the knob may align with the current range displayed by the display member.

Persons skilled in the art will recognize various modifications may be made to the foregoing embodiments; and the principles of the present invention may be applied to other types of exercise equipment, as well. In view of the foregoing, the subject invention should be limited only to the extent of the claims set forth below.

What is claimed is:

1. An exercise apparatus, comprising:

a frame;

a drum rotatably mounted on the frame for rotation about an axis, wherein the drum defines a circumferential perimeter;

a tension band disposed about at least a portion of the perimeter of the drum;

a braking strip disposed between the tension band and the drum;

a tension adjustment mechanism interconnected between the tension band and the frame, and operable to adjust tension in the tension band without affecting tension in the braking strip, wherein the tension adjustment mechanism includes a bolt rotatably mounted on the frame for rotation about a bolt axis, and a slide block threaded onto the bolt and secured to the tension band; and a force receiving member operatively connected to the drum, wherein movement of the force receiving member is linked to rotation of the drum, and a re-directional bearing is rotatably mounted on the frame for rotation about a bearing axis, and a flexible cable is interconnected between the force receiving member and the drum, and an intermediate portion of the flexible cable is routed through the re-directional bearing, and an angle of at least ninety degrees is defined between the bolt axis and the bearing axis where the bolt and the flexible cable extend away from the frame.

2. The exercise apparatus of claim 1, wherein the tension band is made of steel.

3. The exercise apparatus of claim 2, wherein the braking strip is made of Kevlar material.

4. The exercise apparatus of claim 3, wherein the perimeter of the drum is made of steel.

5. The exercise apparatus of claim 1, wherein the braking strip is connected to the frame to discourage rotation together with the drum.

6. The exercise apparatus of claim 1, wherein the frame is sized and configured to form a housing about the drum, and to be held in a person's hand and moved together with the person's hand for exercise purposes.

7. An exercise apparatus, comprising:

a frame;

a drum rotatably mounted on the frame for rotation about an axis, wherein the drum defines a circumferential perimeter;

a tension band disposed about at least a portion of the perimeter of the drum;

a braking strip disposed between the tension band and the drum;

a tension adjustment mechanism interconnected between the tension band and the frame, and operable to adjust tension in the tension band without affecting tension in the braking strip;

a first resistance display member movably mounted on the frame and linked to movement of the tension adjustment mechanism;

a second resistance display member movably mounted on the frame and linked to movement of the tension adjustment mechanism, wherein indicia on the first resistance display member and indicia on the second resistance display member cooperate to show a relative resistance setting in response to operation of the tension adjustment mechanism; and a force receiving member operatively connected to the drum, wherein movement of the force receiving member is linked to rotation of the drum.

8. The exercise apparatus of claim 7, wherein the first resistance display member rotates through more than a complete revolution relative to the frame, and the indicia on the first resistance display member are associated with orientation changes of the first resistance display member, and the indicia on the second resistance display member are associated with revolution changes of the first resistance display member.

9. The exercise apparatus of claim 7, wherein the indicia on the first resistance display member moves relative to the frame in response to operation of the tension adjustment mechanism.

10. The exercise apparatus of claim 9, wherein the indicia on the second resistance display member moves relative to the frame in response to operation of the tension adjustment mechanism.

11. The exercise apparatus of claim 9, wherein the tension adjustment mechanism includes a tensioning bolt operatively interconnected between the tension band and the frame, and the first resistance display member includes a knob that is keyed to the tensioning bolt for rotation together with the tensioning bolt relative to the frame.

12. An exercise, comprising:

a frame;

a drum rotatably mounted on the frame, wherein the drum defines a circumferential perimeter;

a tension band disposed about at least a portion of the perimeter of the drum;

a braking strip disposed between the tension band and the drum;

a tension adjustment mechanism interconnected between the tension band and the frame, and operable to adjust tension in the tension band without affecting tension in the braking strip;

a knob rotatably mounted on the frame and linked to the tension adjustment mechanism, wherein the knob cooperates with the frame to indicate resistance to rotation of the drum in increments associated with orientation of the knob;

a force receiving member operatively connected to the drum, wherein movement of the force receiving member is linked to rotation of the drum; and a resistance display member movably mounted on the frame and linked to the knob, wherein the resistance display member cooperates with the frame to indicate resistance to rotation of the drum in increments associated with rotation of the knob past a point of complete revolution.

13. The exercise apparatus of claim 12, wherein the drum includes a plastic hub, and a cylindrical steel cap mounted on the plastic hub.

14. The exercise apparatus of claim 12, wherein a fastener secures a first end of the tension band to the frame, and the fastener secures at least one end of the braking strip to the frame.

15. The exercise apparatus of claim 12, wherein the resistance display member is rotatably mounted on the frame and linked to the knob via gear teeth.

16. The exercise apparatus of claim 12, wherein the resistance display member is visible through a window in the frame.

17. The exercise apparatus of claim 12, further comprising a second tension band disposed about at least a portion of the perimeter of the drum, wherein the braking strip is disposed between the second tension band and the drum.

18. The exercise apparatus of claim 17, wherein the tension band and the second tension band are diametrically opposed relative to the axis of rotation.

19. The exercise apparatus of claim 17, wherein the braking strip is secured in a loop about the perimeter of the drum.

20. The exercise apparatus of claim 17, wherein the tension adjustment mechanism adjusts tension in each said tension band without affecting tension in the braking strip.

* * * * *